US010472192B2

(12) United States Patent
Mizuta et al.

(10) Patent No.: US 10,472,192 B2
(45) Date of Patent: Nov. 12, 2019

(54) SHEET CONVEYING APPARATUS AND IMAGE FORMING APPARATUS

(71) Applicant: CANON KABUSHIKI KAISHA, Tokyo (JP)

(72) Inventors: Takayuki Mizuta, Numazu (JP); Takehito Osada, Susono (JP); Ken-ichiro Isobe, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/874,184

(22) Filed: Jan. 18, 2018

(65) Prior Publication Data

US 2018/0208419 A1 Jul. 26, 2018

(30) Foreign Application Priority Data

Jan. 23, 2017 (JP) ..... 2017-009723
May 9, 2017 (JP) ..... 2017-093295

(51) Int. Cl.
*B65H 5/36* (2006.01)
*B65H 85/00* (2006.01)
*B65H 5/38* (2006.01)

(52) U.S. Cl.
CPC ..... *B65H 5/36* (2013.01); *B65H 5/38* (2013.01); *B65H 85/00* (2013.01);
(Continued)

(58) Field of Classification Search
CPC ..... B65H 85/00; B65H 2402/441; B65H 2601/11; B65H 2404/611; B65H 5/36; B65H 5/38
See application file for complete search history.

(56) References Cited

U.S. PATENT DOCUMENTS 6,527,267 B1 3/2003 Kuwata et al.
6,643,480 B2 11/2003 Kuwata et al.
(Continued)

FOREIGN PATENT DOCUMENTS

JP H03-044145 U 4/1991
JP 2001-121783 A 5/2001
(Continued)

OTHER PUBLICATIONS

European Search Report dated Jun. 18, 2018, in related European Patent Application No. 18150137.0.
(Continued)

*Primary Examiner* — Patrick Cicchino
(74) *Attorney, Agent, or Firm* — Venable LLP

(57) ABSTRACT

A sheet conveying apparatus includes a cover unit opened and closed with respect to an apparatus body and a guide unit including first and second movable guides respectively movable with respect to the apparatus body. A first conveyance path is formed between the first guide portion and the first movable guide, and a second conveyance path is formed between the second guide portion and the second movable guide. The guide unit is provided with a linking mechanism including an intermediate member for linking the first and second movable guides. The linking mechanism coordinates movements of the first and second movable guides such that the first and second movable guides are respectively moved away from the first and second guide portions along with an opening movement of the cover unit with respect to the apparatus body.

14 Claims, 16 Drawing Sheets

(52) U.S. Cl.
CPC .. *B65H 2402/441* (2013.01); *B65H 2404/611* (2013.01); *B65H 2601/11* (2013.01)

(56) References Cited

U.S. PATENT DOCUMENTS

| | | | | |
|---|---|---|---|---|
| 6,973,279 | B2 * | 12/2005 | Yokoi | G03G 21/1638 399/124 |
| 6,973,285 | B2 | 12/2005 | Sekiyama et al. | |
| 7,819,394 | B2 * | 10/2010 | Shiohara | B65H 5/26 271/9.12 |
| 8,807,559 | B2 | 8/2014 | Osada et al. | |
| 8,820,740 | B2 * | 9/2014 | Sugizaki | B65H 5/00 271/264 |
| 9,718,633 | B2 | 8/2017 | Osada | |
| 2010/0098473 | A1 * | 4/2010 | Hosoi | B65H 5/38 399/400 |
| 2013/0264769 | A1 * | 10/2013 | Sugizaki | B65H 5/00 271/264 |
| 2017/0283197 | A1 | 10/2017 | Osada | |

FOREIGN PATENT DOCUMENTS

| | | | |
|---|---|---|---|
| JP | 2001-253585 | A | 9/2001 |
| JP | 2002-053242 | A | 2/2002 |
| JP | 2004-331391 | A | 11/2004 |
| JP | 2008-292517 | A | 12/2008 |

OTHER PUBLICATIONS

European Search Report dated Jun. 21, 2018, in related European Patent Application No. 18150137.0.

* cited by examiner

SHEET CONVEYING APPARATUS AND IMAGE FORMING APPARATUS

BACKGROUND OF THE INVENTION

Field of the Invention

The present invention relates to a sheet conveying apparatus configured to convey a sheet and to an image forming apparatus including the sheet conveying apparatus.

Description of the Related Art

Some sheet conveying apparatus used in an image forming apparatus such as a printer, a copier, and a multi-function printer are configured such that a part of a conveyance guide is movable with respect to an apparatus body to be able to readily remove a sheet jammed within the apparatus. For instance, Japanese patent application laid-open No. 2001-253585 discloses a copying machine including a guide member configured to be able to be pulled out of an apparatus body along a moving rail. Japanese patent application laid-open No. 2001-121783 also discloses a printer configured such that a sheet discharge cover having a guide portion is turnable with respect to a printer body and such that a part of a sheet discharge path is opened by opening the sheet discharge cover.

By the way, it is conceivable to dispose a plurality of movable guides configured to be movable with respect to an apparatus body in order to facilitate a sheet removing operation more. However, such a configuration that requires an operator to move each of the plurality of movable guides will increase an operational complexity.

SUMMARY OF THE INVENTION

The present disclosure provides a sheet conveying apparatus including a plurality of movable guides that are easy to handle, and an image forming apparatus including the sheet conveying apparatus.

According to one aspect of the present invention, a sheet conveying apparatus includes: an apparatus body provided with a first guide portion and a second guide portion; a cover unit configured to be opened and closed with respect to the apparatus body; a sheet conveyance portion configured to convey a sheet; and a guide unit configured to guide the sheet conveyed by the sheet conveyance portion. The guide unit includes: a first movable guide supported movably by the apparatus body and configured such that a first conveyance path through which the sheet conveyed by the sheet conveyance portion passes is formed between the first guide portion and the first movable guide; a second movable guide being movable with respect to the apparatus body and configured such that a second conveyance path through which the sheet conveyed by the sheet conveyance portion passes is formed between the second guide portion and the second movable guide; and a linking mechanism including an intermediate member through which the first and second movable guides are linked movably with respect to each other. The linking mechanism is configured to coordinate movements of the first and second movable guides through an intermediary of the intermediate member such that the first and second movable guides are respectively moved away from the first and second guide portions along with an opening movement of the cover unit with respect to the apparatus body from a state where the first and second conveyance paths are formed respectively between the first movable guide and the first guide portion and between the second movable guide and the second guide portion.

According to another aspect of the present invention, a sheet conveying apparatus includes: an apparatus body provided with a first guide portion and a second guide portion; a cover unit configured to be opened and closed with respect to the apparatus body; a sheet conveyance portion configured to convey a sheet; and a guide unit configured to guide the sheet conveyed by the sheet conveyance portion. The guide unit includes: a first movable guide supported movably by the apparatus body and configured such that a first conveyance path through which the sheet conveyed by the sheet conveyance portion passes is formed between the first guide portion and the first movable guide; a second movable guide being movable with respect to the apparatus body and configured such that a second conveyance path through which the sheet conveyed by the sheet conveyance portion passes is formed between the second guide portion and the second movable guide; and a linking mechanism including a support member supported by the apparatus body and movably supporting each of the first and second movable guides. The linking mechanism is configured to coordinate movements of the first and second movable guides such that the first and second movable guides are respectively moved away from the first and second guide portions along with an opening movement of the cover unit with respect to the apparatus body from a state where the first and second conveyance paths are formed respectively between the first movable guide and the first guide portion and between the second movable guide and the second guide portion.

Further features of the present invention will become apparent from the following description of exemplary embodiments with reference to the attached drawings.

DESCRIPTION OF THE EMBODIMENTS

A sheet conveying apparatus, an image forming apparatus and others of the present disclosure will be described below with reference to the drawings.

First Embodiment

Figure 1:
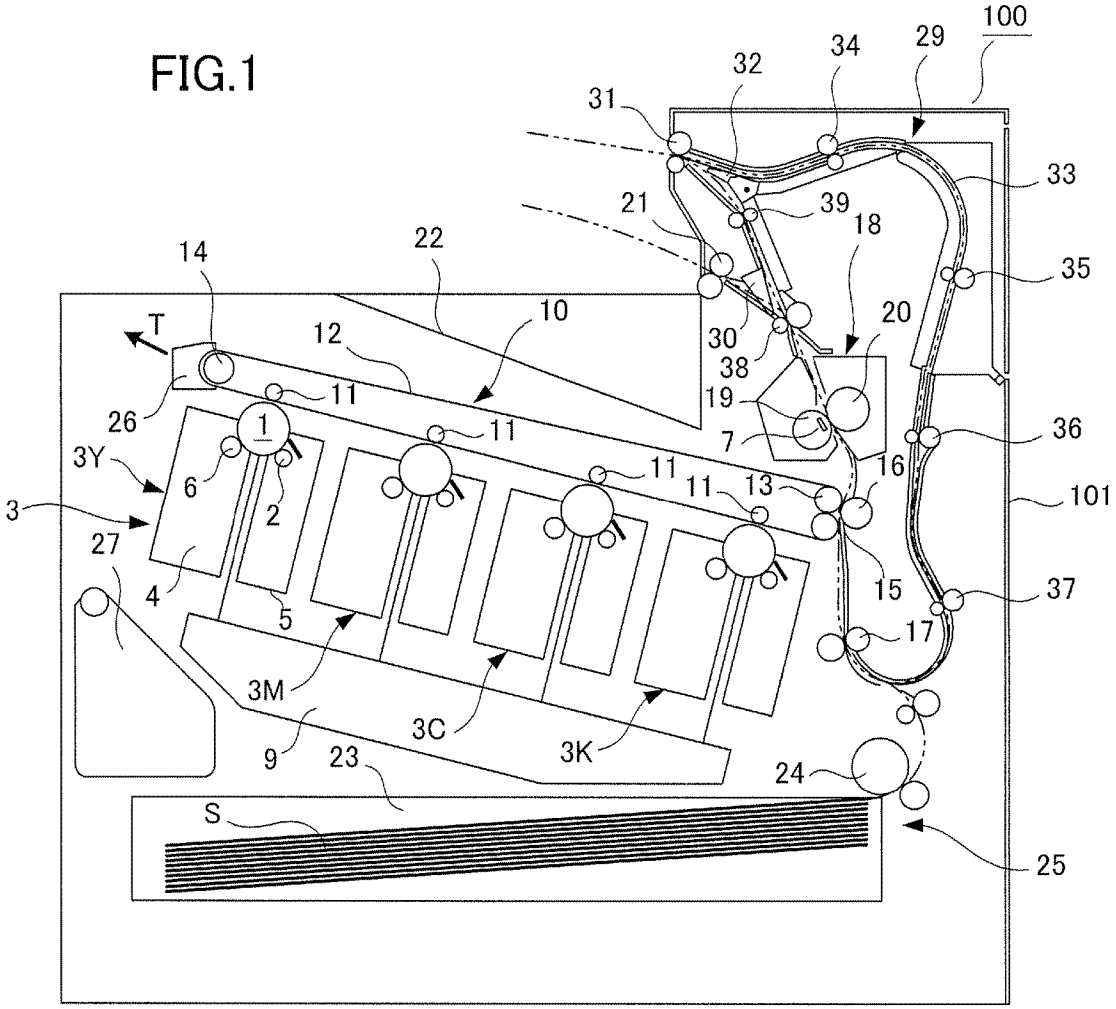
FIG. 1 is a schematic diagram illustrating a configuration of an image forming apparatus of a first embodiment.

As illustrated in FIG. 1, an image forming apparatus 100 is a color laser beam printer configured to form an image on a sheet S which is used as a recording medium. The image forming apparatus 100 forms an image on the sheet S based on image information read from a document or inputted from an external device, and then discharges the sheet S. It is noted that the sheet S includes, besides a plain sheet of paper, a special sheet such as a coated sheet, a recording member having a specific shape such as an envelope and an index sheet, a plastic film for an overhead projector, a cloth or the like.

An apparatus body 101 of the image forming apparatus 100 includes an intermediate-transfer tandem type image forming portion 3 including four image forming units 3Y, 3M, 3C and 3K and an intermediate transfer unit 10. The four image forming units 3Y, 3M, 3C and 3K form toner images of yellow, magenta, cyan and black, respectively. Because configurations of the respective image forming units are substantially same except of colors of toners used for development, the configuration of the image forming unit and a toner image forming operation will be described below by exemplifying the image forming unit 3Y.

In response to a request to the image forming unit 3Y to form a toner image, a photosensitive drum 1 serving as a photosensitive body is driven to rotate, and the surface of the photosensitive drum 1 is uniformly electrified by an electrifying unit 2. An exposure unit 9, disposed at a lower part the apparatus body 101, projects a laser beam based on image information to the photosensitive drum 1 to expose the drum surface and to form an electrostatic latent image on the surface of the photosensitive drum 1. Then, by visualizing (developing) the electrostatic latent image with toner supplied from a developing unit 6, a toner image is formed on the surface of the photosensitive drum 1.

Toner images of corresponding colors are formed in the same manner also in the image forming units 3M, 3C and 3K. The toner images formed by the respective image forming units 3Y, 3M, 3C and 3K are primarily transferred by primary transfer rollers 11 from the photosensitive drums 1 to an intermediate transfer belt 12 serving as an intermediate transfer body so as to be superimposed with each other. Attached substances, such as toner remaining on the photosensitive drum 1, are removed by a cleaning unit provided in each of the image forming units 3Y, 3M, 3C and 3K and are collected into a collection container 27.

The intermediate transfer belt 12 is wrapped around a secondary transfer inner roller 13, a tension roller 14 and others, and is driven to rotate counterclockwise in FIG. 1. The tension roller 14 is urged in a direction of an arrow T by an urging member such as a spring to give an adequate tension to the intermediate transfer belt 12. The toner image borne on the intermediate transfer belt 12 is secondarily transferred onto the sheet S at a secondary transfer portion formed between a secondary transfer roller 16 facing the secondary transfer inner roller 13 and the intermediate transfer belt 12. Attached substances such as toner remaining on the intermediate transfer belt 12 are removed by a belt cleaning unit 26 and are collected into the container 27. The sheet S onto which the toner image has been transferred is passed to a fixing unit 18. The fixing unit 18 includes a heating roller 19, a counter roller 20, and a heating element 7 such as a halogen heater, and applies heat and pressure to the toner image while nipping and conveying the sheet S. Thereby, the image is fixed to the sheet S as the toner melts and adheres to the sheet S.

In parallel with such an image forming process, a sheet feed portion 25 feeds the sheet S toward the image forming portion 3. The sheet feed portion 25 includes a sheet feed cassette 23 serving as a sheet storage portion and a feed roller 24 configured to deliver the sheet S from the sheet feed cassette 23. The sheet S fed by the feed roller 24 is conveyed toward a registration portion 17, being separated from other sheets by a separating device such as a retard roller or a separation pad. It is noted that the feed roller 24 is one exemplary sheet feeding device capable of feeding a sheet and may be replaced by another sheet feed mechanism such as an air sheet-feeding system.

The registration portion 17 is configured to correct a skew of the sheet S and to send the sheet S toward the secondary transfer portion in synchronization with the image forming process in the image forming portion 3. The sheet S, onto which the image has been formed by passing through the secondary transfer portion and the fixing unit 18, is delivered to a conveyance roller pair 38 located downstream of the fixing unit 18. A flap-shaped switching guide 30 configured to sort the sheet S either to a discharge roller pair 21 or to a duplex conveyance portion 29 is disposed downstream of the conveyance roller pair 38. In a case of simplex printing, or single-sided printing, the sheet S sent out of the conveyance roller pair 38 is guided by the switching guide 30 toward the discharge roller pair 21 and is discharged to a discharge tray 22 provided at an upper part of the apparatus body 101. In a case of duplex printing, or double-sided printing, the sheet S is guided by the switching guide 30 toward the duplex conveyance portion 29. As described later, the duplex conveyance portion 29 switches back and conveys the sheet S again to the image forming portion 3 through a re-conveyance path 33 in a state where front and back surfaces of the sheet S are reversed. Then, the sheet S onto the back surface of which an image has been formed by the image forming portion 3 is guided by the switching guide 30 toward the discharge roller pair 21 and is discharged to the discharge tray 22.

It is noted that the image forming portion 3 is merely one exemplary image forming unit configured to form the image on the sheet S and may be replaced by another image forming mechanism such as a direct-transfer type electrophotographic mechanism or an ink-jet printing system.

Duplex Conveyance Portion

Figure 2:
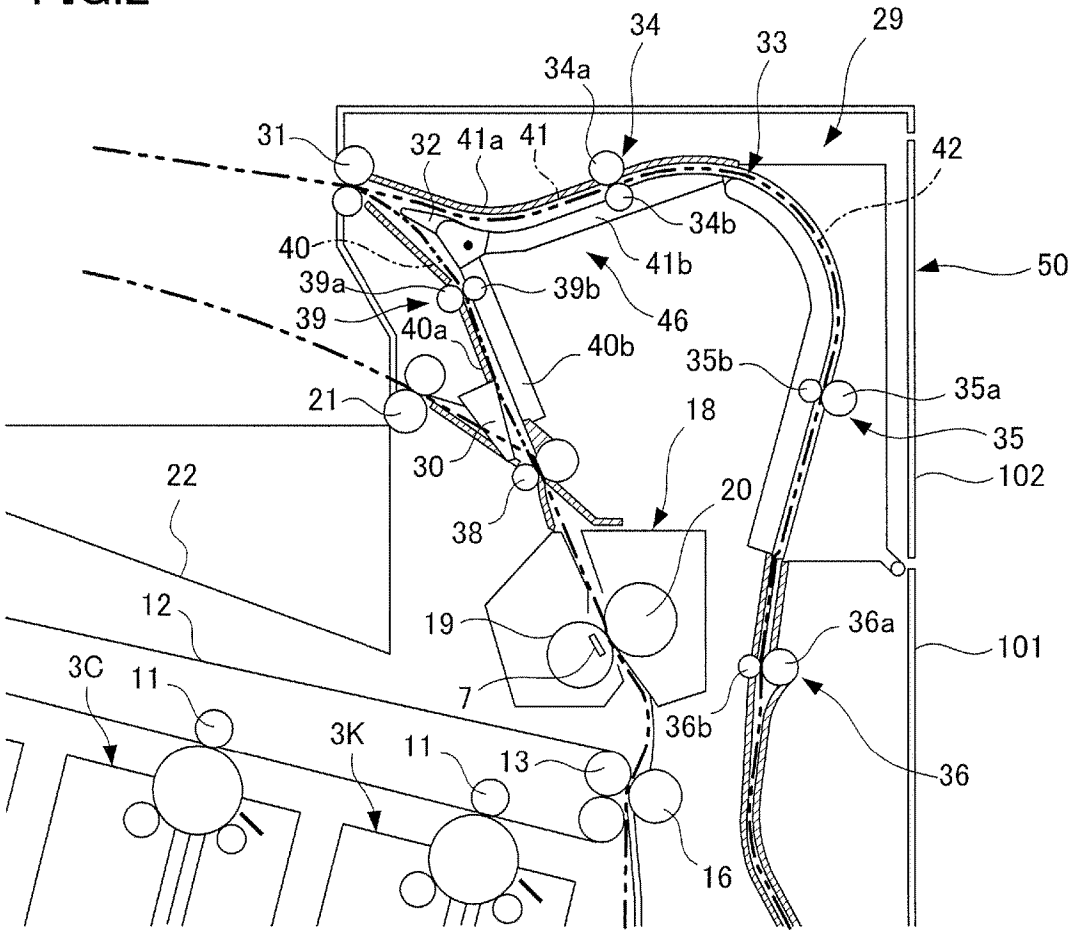
FIG. 2 is a schematic diagram illustrating a duplex conveyance portion of the first embodiment.

Next, a configuration of the duplex conveyance portion 29, which is one exemplary sheet conveying apparatus, will be described in detail with reference to FIG. 2. The duplex conveyance portion 29 includes guides 40*a* and 40*b* composing a switchback path 40, and guides 41*a* and 41*b* composing an upstream portion 41 of the re-conveyance path 33. The duplex conveyance portion 29 further includes, as a sheet conveyance portion in this embodiment, a switchback roller pair 31, a conveyance roller pair 39 and re-conveyance roller pairs 34, 35, 36 and 37.

The switchback path 40 is a sheet conveyance path extending upward from the switching guide 30 to the switchback roller pair 31 located above the discharge roller pair 21. The switchback path 40 is composed of the fixed guide 40*a* fixed to the apparatus body 101 and the movable guide 40*b* facing the fixed guide 40*a*. The switchback path 40 is provided with the conveyance roller pair 39 composed of a driving roller 39*a* and a driven roller 39*b*, and is configured to convey the sheet guided by the switching guide 30 to the switchback path 40 toward the switchback roller pair 31.

The switchback roller pair 31, which serves as a reverse conveyance portion, is a roller pair driven either in normal and reverse directions and reverses the sheet received from the conveyance roller pair 39 by switching back the sheet. That is, the switchback roller pair 31 rotates in the normal direction to convey the sheet received from the conveyance roller pair 39 such that a downstream portion in a conveyance direction of the sheet protrudes above the discharge tray 22. When a trailing end of the sheet (i.e., an upstream end in the conveyance direction of the sheet conveyed by the conveyance roller pair 39) passes through a regulating member 32 which separates the switchback path 40 from the re-conveyance path 33, the switchback roller pair 31 starts to rotate reversely before the trailing end of the sheet passes through a nip portion of the switchback roller pair 31. The regulating member 32 serving as a conveyance regulating portion guides the sheet conveyed by the reverse rotation of the switchback roller pair 31 to the re-conveyance path 33, and restricts the sheet from being reversely conveyed to the switchback path 40.

The re-conveyance path 33 is a sheet conveyance path extending approximately in a vertical direction from the switchback roller pair 31 to the registration portion (see FIG. 1). The upstream portion 41 of the re-conveyance path 33 (i.e., a part receiving the sheet delivered from the switchback roller pair 31) is composed of the fixed guide 41*a* fixed to the apparatus body 101 and the movable guide 41*b* facing the fixed guide 41*a*. The re-conveyance roller pairs 34, 35, 36, which are composed of respective driving rollers 34*a*, 35*a* and 36*a* and respective driven rollers 34*b*, 35*b* and 36*b*, are disposed at intervals along the sheet conveyance direction of the re-conveyance path 33. The re-conveyance roller pairs 34, 35, 36 convey the sheet received from the switchback roller pair 31 toward the registration portion 17.

The switchback path 40 is a first conveyance path in this embodiment, while the movable guide 40*b* and the fixed guide 40*a* being respectively a first movable guide and a first guide portion in this embodiment. The upstream portion 41 of the re-conveyance path 33 is a second conveyance path in this embodiment, while the movable guide 41*b* and the fixed guide 41*a* being respectively a second movable guide and a second guide portion in this embodiment. The conveyance roller pair 39 is a first conveyance roller pair disposed along the first conveyance path in this embodiment, and the re-conveyance roller pair 34 is a second conveyance roller pair disposed along the second conveyance path in this embodiment. It is noted that the switchback path 40 and the upstream portion 41 of the re-conveyance path 33 are exemplary first and second conveyance paths and may be independent conveyance paths. That is, the first and second conveyance paths do not necessarily compose a continuous conveyance path through which the sheet is delivered from one conveyance path to the other conveyance path.

Configuration for Opening Conveyance Paths

Figure 3:
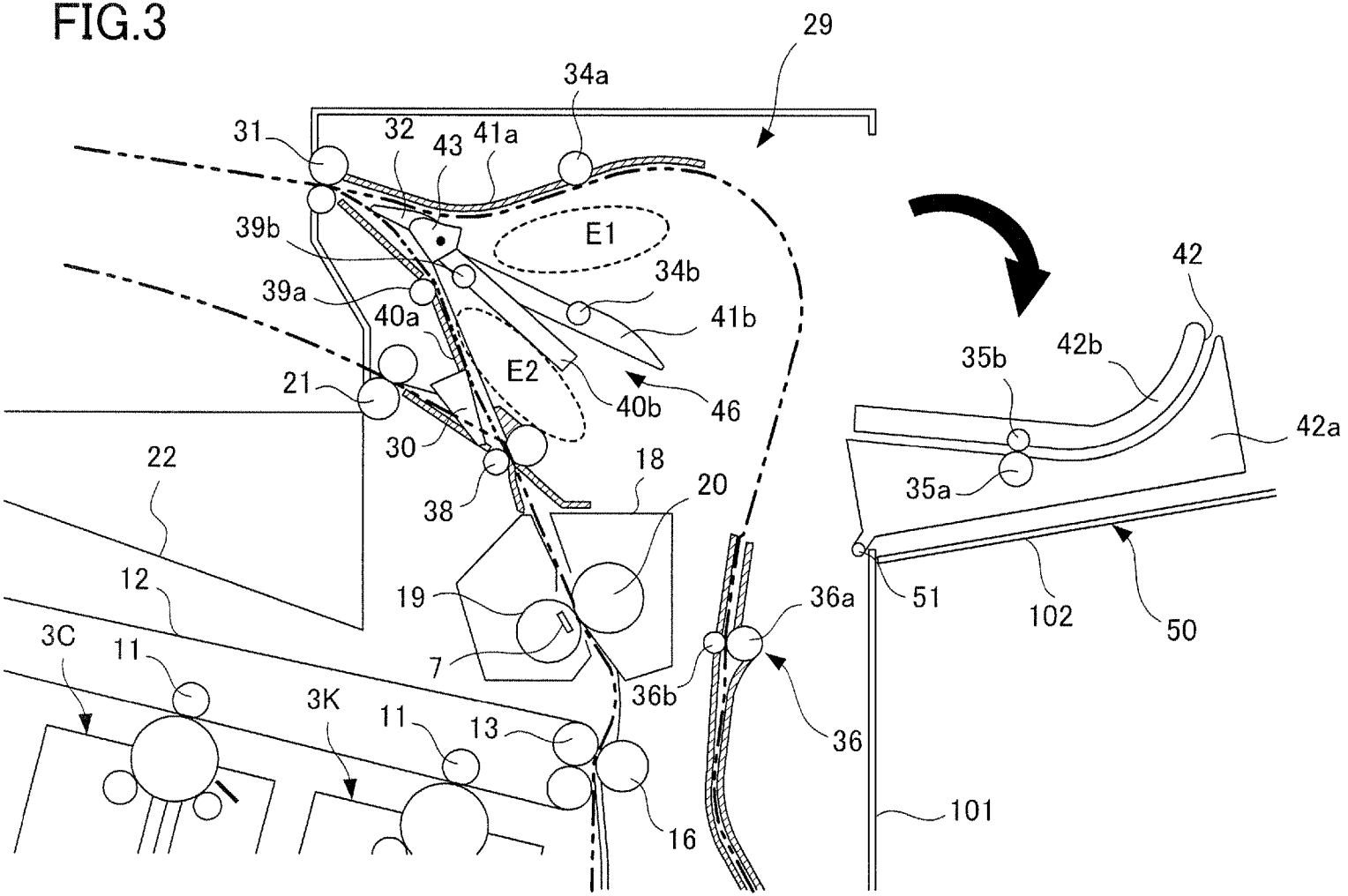
FIG. 3 is a schematic diagram illustrating a state where an openable cover of the duplex conveyance portion of the first embodiment is opened.

Next, a configuration for opening the above-described conveyance paths will be described. These paths are opened in order to remove a sheet jammed in the switchback path 40 and/or the re-conveyance path 33 or to maintenance operation relating to these conveyance paths. As illustrated in FIGS. 2 and 3, the image forming apparatus 100 is provided with an openable cover 50 serving as a cover unit supported movably between a closed position (in FIG. 2) and an open position (in FIG. 3). The openable cover 50 includes a cover portion 102 constituting a part of a side surface of the apparatus body 101 when it is located at the closed position, guides 42*a* and 42*b* serving as a cover guide portion forming the conveyance path 42, and the re-conveyance roller pair 35. In a state where the openable cover 50 is located at the closed position, the conveyance path 42 formed of the guides 42*a* and 42*b* constitutes a part of the re-conveyance path 33.

As illustrated in FIG. 3, the openable cover 50 is moved from the closed position to the open position by turning outward (i.e., in the right direction in FIG. 3) with respect to the apparatus body 101 pivoting on a rotational shaft 51 provided at a lower part of the openable cover 50. In a state where the openable cover 50 is located at the open position, drive transmission from a driving source disposed in the apparatus body 101 to the re-conveyance roller pair 35 is released, and the conveyance path 42 formed by the guides 42*a* and 42*b* is separated from other parts of the re-conveyance path 33.

Here, the movable guide 40*b* composing the switchback path 40 and the movable guide 41*b* composing the re-conveyance path 33 compose a guide unit 46 linked through a link guide 43 serving as a support member. The link guide 43 is an intermediate member in this embodiment. The link guide 43 is supported by a frame of the apparatus body 101 and the movable guides 40*b* and 41*b* are each supported turnably by the link guide 43.

The movable guides 40*b* and 41*b* are movable to first positions (see FIG. 2) for forming the conveyance paths with the respective fixed guides 40*a* and 41*a* and to second positions (see FIG. 3) being away from the respective fixed guides 40*a* and 41*a*. In a state where the movable guides 40*b* and 41*b* are both located at the first positions (referred to as 'a first state' of the guide unit 46), the switchback path 40 and the upstream portion 41 of the re-conveyance path 33 are formed. In a state where the movable guides 40*b* and 41*b* are both located at the second positions (referred to as 'a second state' of the guide unit 46), workspaces E1 and E2 to which an operator can readily access are formed (see FIG. 3) between the guide unit 46 and the fixed guides 40*a* and 41*a*. Still further, the driven rollers 39*b* and 34*b* of the conveyance roller pair 39 and the re-conveyance roller pair 34 are moved away from the respective driving rollers 39*a* and 34*a* in the second state, so that nip portions of these roller pairs 34 and 39 are opened.

Figure 4:
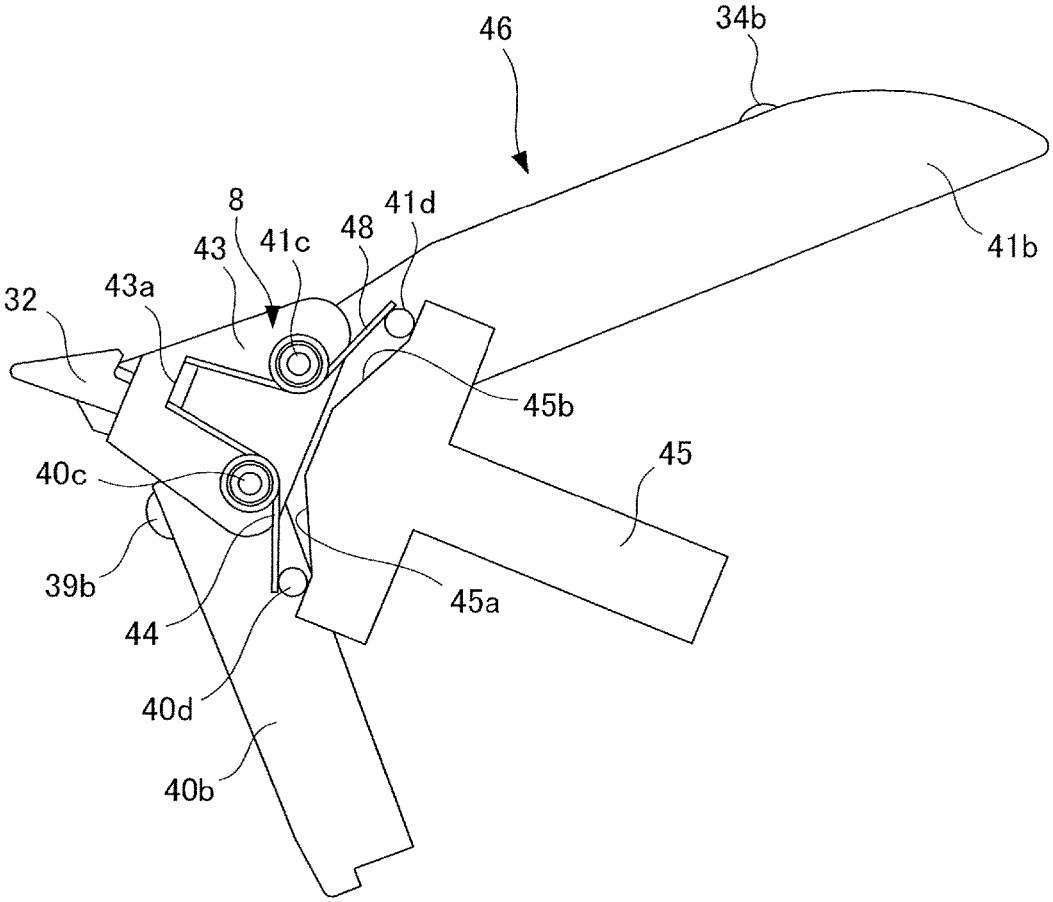
FIG. 4 is a schematic diagram illustrating a configuration of a guide unit of the first embodiment.
Figure 5:
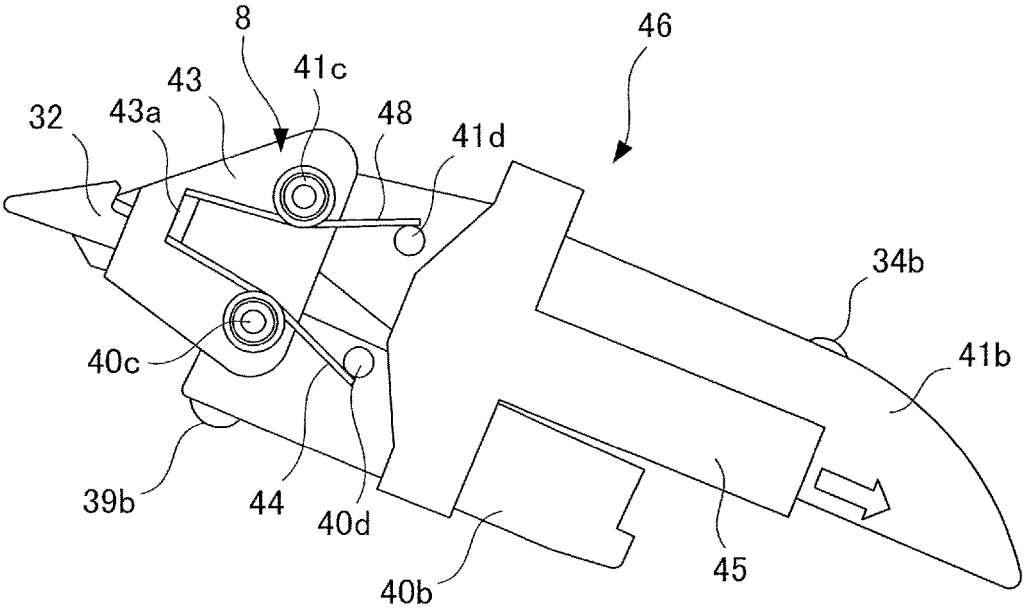
FIG. 5 is a schematic diagram illustrating an operation of the guide unit of the first embodiment.

A configuration of the guide unit 46 will be detailed below with reference to FIGS. 4 and 5. FIG. 4 is a schematic diagram illustrating the guide unit 46 in the first state, and FIG. 5 is a schematic diagram illustrating the guide unit 46 in the second state. As illustrated in FIG. 4, the guide unit 46 includes the link guide 43, the movable guides 40*b* and 41*b*, the regulating member 32, torsion coil springs 44 and 48 and a moving member 45.

The movable guides 40*b* and 41*b* are turnable centering on shafts 40*c* and 41*c* of the link guide 43. The regulating member 32 is supported swingably by the link guide 43. The torsion coil springs 44 and 48 serving as urging members are loosely fitted around the shafts 40*c* and 41*c* and press projections 40*d* and 41*d* of the movable guides 40*b* and 41*b* in a state where their fixed arms are held by a projection 43*a* of the link guide 43. Thereby, the torsion coil springs 44 and 48 urge the movable guides 40*b* and 41*b* in respective directions heading from the first positions to the second positions. The driven rollers 34*b* and 39*b* are supported by the movable guides 40*b* and 41*b* and are positioned such that they come into contact with the corresponding driving rollers 34*a* and 39*a* in a case where the movable guides 40*b* and 41*b* are located at the first positions.

The moving member 45 is configured to keep the movable guides 40*b* and 41*b* at the first positions by pressing the projections 40*d* and 41*d* of the movable guides 40*b* and 41*b*. The moving member 45 functions also as an operable portion that can be operated in a state where the openable cover 50 is opened. The moving member 45 is moved by being operated by an operator between a hold position (see FIG. 4) where the movable guide 40*b* and 41*b* are held at the first positions and a retreat position (see FIG. 5) where the moving member 45 is separated from the projections 40*d* and 41*d*. That is, in this embodiment, a linking mechanism 8 to coordinate movements of the movable guides 40*b* and 41*b* is composed of the link guide 43, the torsion coil springs 44 and 48 and the moving member 45.

If the moving member 45 retreats to the retreat position, the movable guides 40*b* and 41*b* move to the second positions by the urging force of the torsion coil springs 44 and 48, and the guide unit 46 is switched from the first state to the second state as illustrated in FIG. 5. If the moving member 45 is pressed into the hold position, the guide unit 46 is widened (see FIG. 4) resisting against the urging force of the torsion coil springs 44 and 48 by inclined surfaces 45*a* and 45*b* of the moving member 45. Thereby, the movable guides 40*b* and 41*b* move to the first positions, and the guide unit 46 is switched from the second state to the first state.

Such configuration permits the guide unit 46 to be switched to the second state by the linking mechanism 8 when the moving member 45 is moved from the hold position to the retreat position in a state where the openable cover 50 is open, in such a case where a sheet is jammed in a vicinity of the conveyance roller pair 39. This arrangement enables the movable guides 40*b* and 41*b* to move away from the fixed guides 40*a* and 41*a* such that the workspaces E1 and E2 that permit an operator to access the sheet jammed in the switchback path 40 and the re-conveyance path 33 are provided. Because the movable guides 40*b* and 41*b* forming the first and second conveyance paths (the paths 41 and 42 in this embodiment) are separated in conjunction from the respective fixed guides 40*a* and 41*a* by the operation of the linking mechanism 8, an operational complexity for moving the plurality of movable guides is reduced. Still further, because the switchback path 40 distant (left side in FIG. 2) from the openable cover 50 as compared to the re-conveyance path 33 is opened together with the upstream portion 41 of the re-conveyance path 33, the access can be readily made even to the position deep inside of the apparatus. It is noted that in a state where the moving member 45 is located at the retreat position, this configuration makes it possible for an operator to swing the movable guides 40*b* and 41*b* beyond an urging range of the torsion coil springs 44 and 48 and to widen the workspaces E1 and E2 further.

It is noted that instead of the configuration in which the moving member 45 is operated by an operator, a linkage to link the moving member 45 with the openable cover may be provided so that the moving member 45 is moved to the hold position and the retreat position in conjunction with opening and closing movement of the openable cover 50. With such a modification, because no space for gripping the moving member 45 needs to be provided, a larger workspaces E1 and E2 for handling a jammed sheet or the like will be provided, thereby further improving workability.

Second Embodiment

Figure 6:
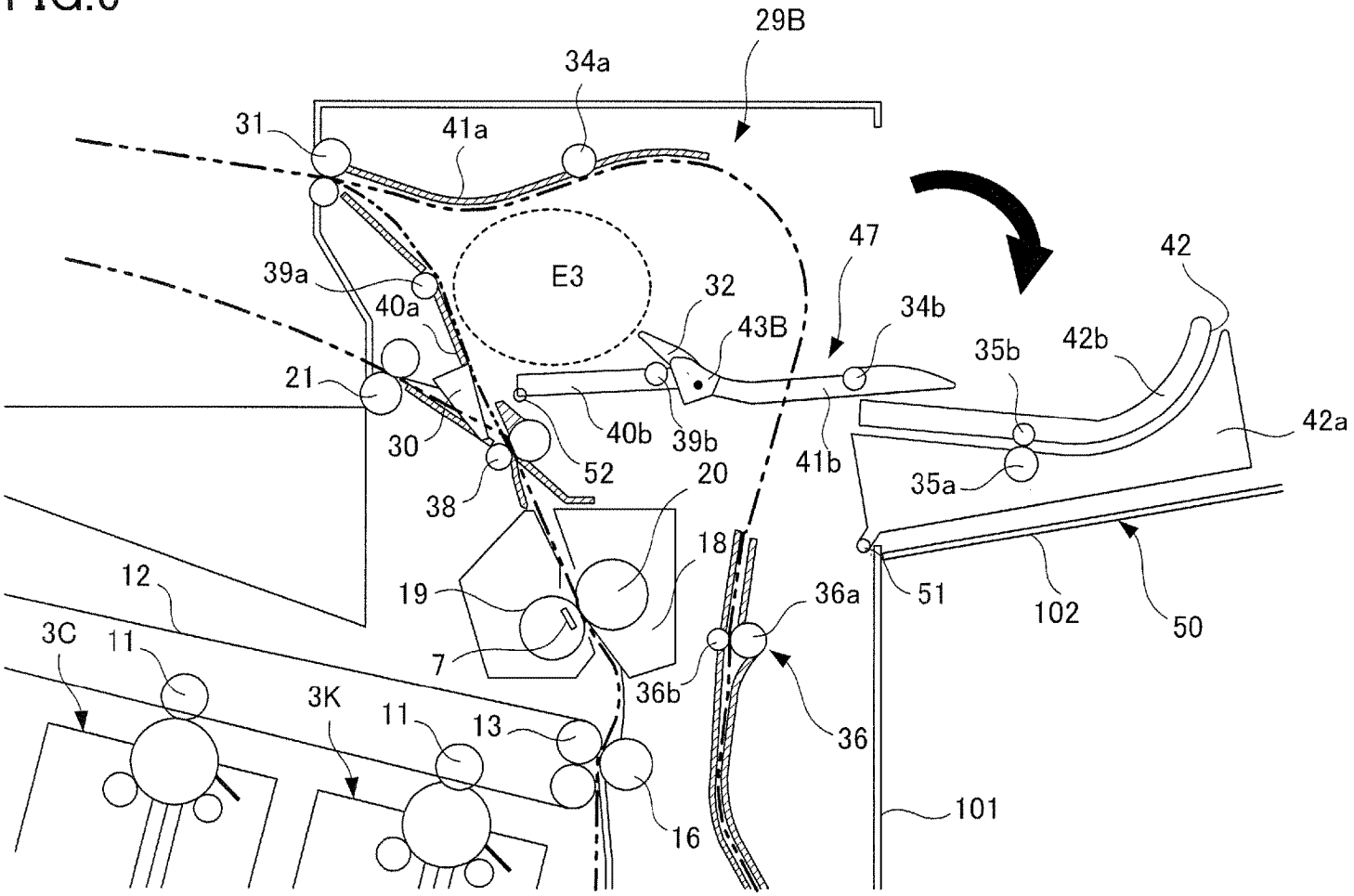
FIG. 6 is a schematic diagram illustrating a duplex conveyance portion of a second embodiment.
Figure 7:
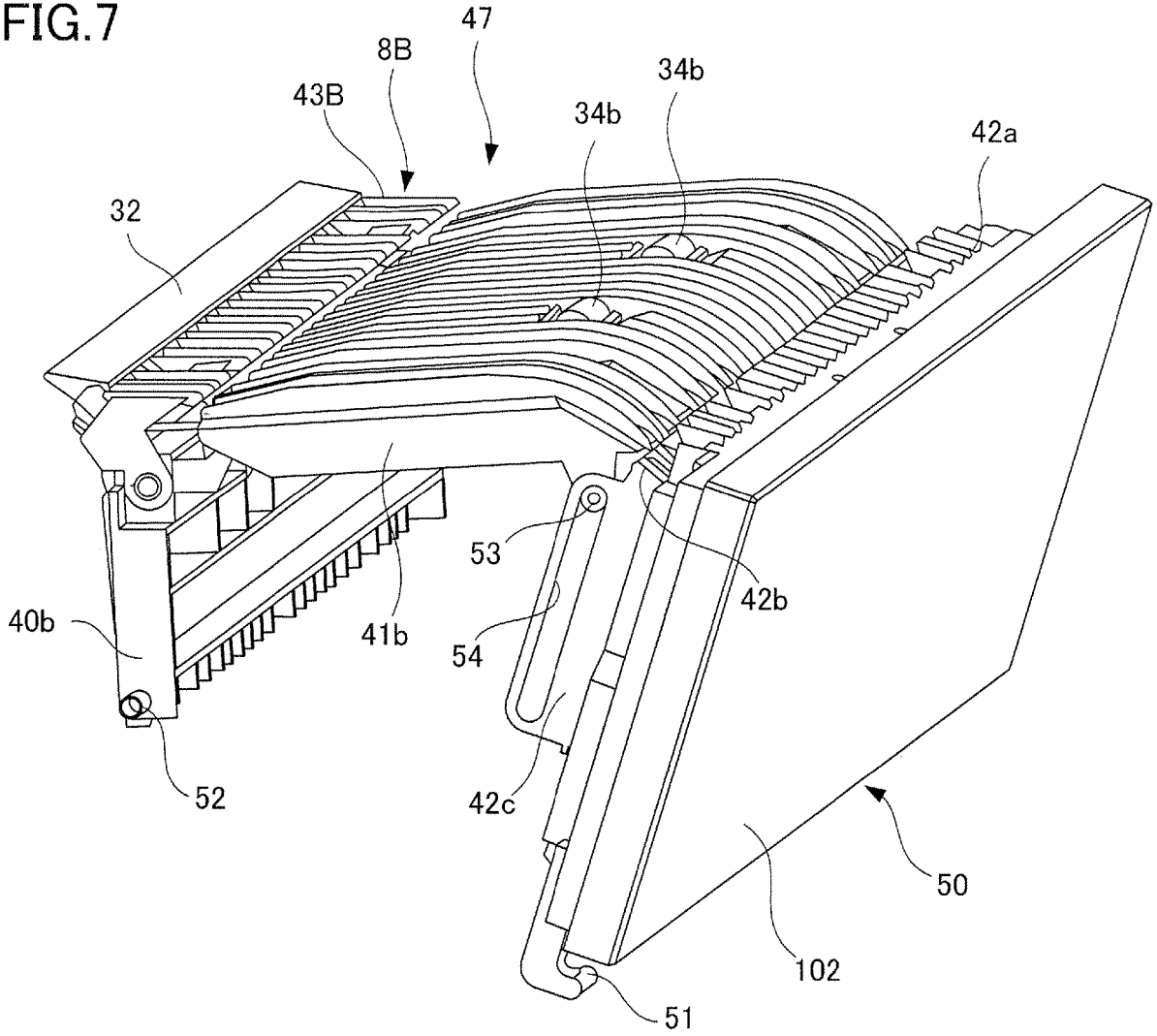
FIG. 7 is a perspective view illustrating a guide unit and an openable cover of the second embodiment.
Figure 8:
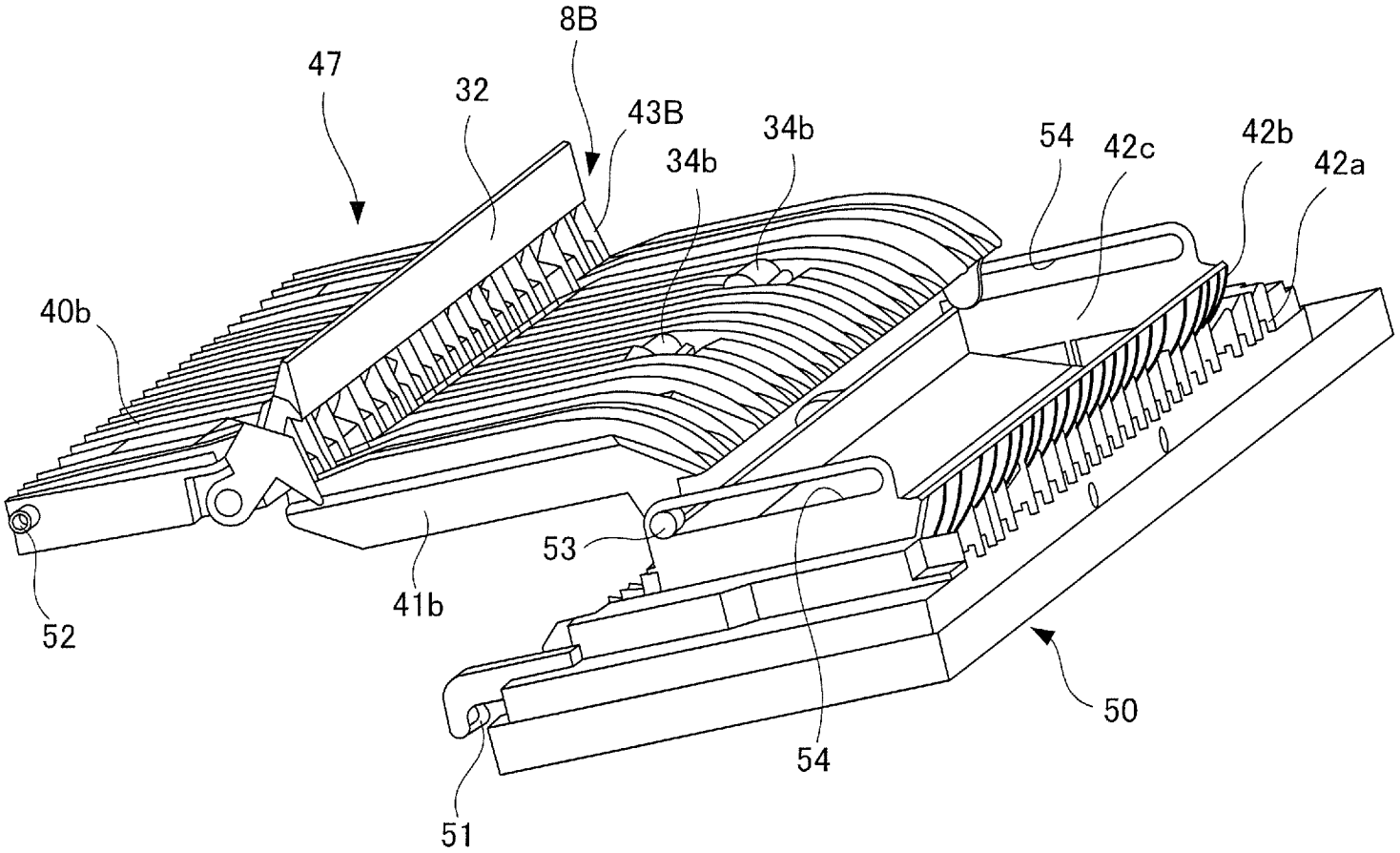
FIG. 8 is a perspective view illustrating an operation of the guide unit of the second embodiment.

Next, a configuration of a duplex conveyance portion 29B, which is a sheet conveying apparatus of a second embodiment, will be described with reference to FIGS. 6 through 8. The duplex conveyance portion 29B is different from the first embodiment in that the guide unit is configured to move in conjunction with the opening/closing operation of the openable cover 50. Components common with those of the first embodiment will be denoted by the same reference numerals with those in the first embodiment and an explanation thereof will be omitted here. FIG. 6 is a schematic diagram illustrating the duplex conveyance portion 29B in a state where the openable cover 50 is open. FIG. 7 is a perspective view illustrating the guide unit 47 in a state where the openable cover 50 is closed, and FIG. 8 is a perspective view illustrating the guide unit 47 in a state where the openable cover 50 is open.

As illustrated in FIG. 6, the duplex conveyance portion 29B includes, similarly to the duplex conveyance portion 29 of the first embodiment, the switchback path 40 serving as the first conveyance path, the re-conveyance path 33 serving as the second conveyance path, and the switchback roller pair 31 serving as the reverse conveyance portion. The duplex conveyance portion 29B also includes the plurality of roller pairs configured to convey a sheet through the switchback path 40 and the re-conveyance path 33 as a sheet conveyance portion in this embodiment (see the conveyance roller pair 39 and the re-conveyance roller pairs 34 through 37 of the first embodiment illustrated in FIG. 1). The sheet guided by the switching guide 30 to the switchback path 40 is delivered to the switchback roller pair 31 through the conveyance roller pair 39 and is switched back by the operation of the switchback roller pair 31. Then, the sheet sent to the re-conveyance path 33 is transferred through the re-conveyance roller pairs 34 through 37 to be conveyed again to the image forming portion 3.

Here, the guide unit 47 is composed of the movable guides 40*a* and 40*b* linked through a link guide 43B, which is an intermediate member in this embodiment, while the movable guide 40*b* forming the switchback path 40 and the movable guide 41*b* forming the upstream portion 41 of the re-conveyance path 33. The movable guide 40*b* is supported by the apparatus body 101 turnably pivoting on the rotational shaft 52 provided at one end thereof and is linked turnably with the link guide 43B at another end thereof. Accordingly, differing from the first embodiment, the link guide 43B is movable relatively with respect to the apparatus body 101. The movable guide 41*b* is linked with the link guide 43B turnably at one end thereof and is linked to the openable cover 50 at another end thereof.

As illustrated in FIGS. 6 and 7, the openable cover 50 turnable around the rotational shaft 51 is provided with guides 42*a* and 42*b* forming the conveyance path 42 composing a part of the re-conveyance path 33 in a state where the openable cover 50 is closed with respect to the apparatus body. The openable cover 50 is also provided with a support plate 42*c* in which a guiding groove 54 is provided on both sides in a sheet width direction (in a depth direction in FIG. 7). The movable guide 41*b* is provided with an engage pin 53 at an end portion thereof opposite from the link guide 43B. The pin 53, which is a first link portion in this embodiment, is slidably engaged with the guiding groove 54, which is a second link portion in this embodiment.

An operation of the guide unit 47 constructed as described above will be described below. As illustrated in FIG. 7, the engage pin 53 is located at one end of the guiding groove 54 in a state where the openable cover 50 is closed. In this state, the switchback path 40 is formed by the fixed guide 40*a* and the movable guide 40*b*, and the upstream portion 41 of the re-conveyance path 33 is formed by the fixed guide 41*a* and the movable guide 41*b* (see FIG. 2). It is noted that the movable guide 40*b* is urged toward the fixed guide 40*a* by an elastic member not illustrated, so that the movable guide 40*b* keeps its posture in a state where the openable cover 50 is closed.

When the openable cover 50 is opened as illustrated in FIG. 8, the engage pin 53 is pulled toward outside of the apparatus body 101 (i.e., in the right direction in FIG. 8) as the openable cover 50 moves, and along with that, the movable guide 41*b* moves. The movable guide 40*b* also turns with respect to the apparatus body 101 through a movement of the link guide 43B. That is, a linking mechanism 8B is composed of the link guide 43B, the rotational shaft 52, the engage pin 53 and the guiding groove 54 in the present embodiment. Then, because the movable guides 40*b* and 41*b* move away from the fixed guides 40*a* and 41*a* as illustrated in FIG. 6, a workspace E3 to which an operator can readily access is secured between the guide unit 47 and the fixed guides 40*a* and 41*a*.

As described above, the arrangement of the present embodiment also makes it possible to provide the workspace E3 to which an operator can readily access to remove a sheet or the like jammed in the switchback path 40 or in the re-conveyance path 33 by switching the guide unit 47 into the second state by means of the linking mechanism 8B. Still further, because the linking mechanism 8B switches the guide unit 47 into the second state along with the opening operation of the openable cover 50, the operational complexity of an operator will be reduced. It is also possible to modify such that an operator can switch the guide unit 47 between the first and second states by gripping and moving a part of the movable guide 41*b* in a state where the openable cover 50 is open.

Still further, along with the opening operation of the openable cover 50, a part of the guide unit 47 projects out of the apparatus body 101 through an opening (see FIG. 6) which is covered by a cover portion 102 in a state where the openable cover 50 is closed. This arrangement enables to provide the fully wide workspace E3 and to improve workability further. Then, if the openable cover 50 is opened such that the engage pin 53 comes into contact with the other end of the guiding groove 54 as illustrated in FIG. 8, the openable cover 50 is locked through the guide unit 47 and the turn of the openable cover 50 in an opening direction is regulated (see FIG. 8). That is, a movable range of the openable cover 50 is limited by using the configuration for moving the movable guides 40*b* and 41*b*. This arrangement makes it possible to simplify the configuration of this embodiment as compared to another configuration provided with a stopper, apart from the guide unit 47, for limiting the movable range of the openable cover 50.

Figure 9A:
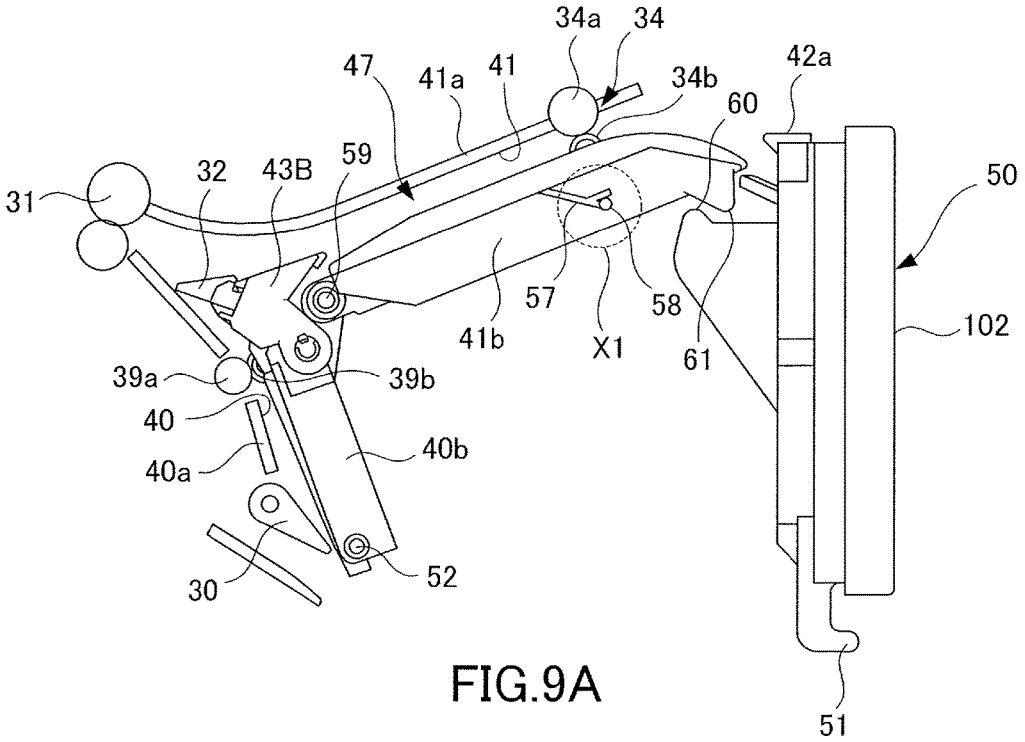
FIG. 9A is a schematic diagram illustrating a positioning configuration of the guide unit of the second embodiment.
Figure 9B:
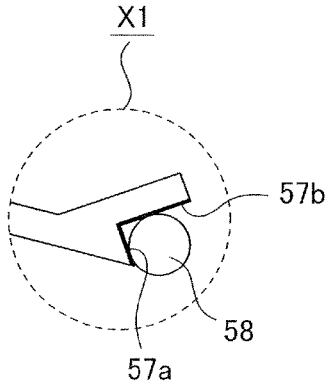
FIG. 9B is an enlarged view of the FIG. 9A.
Figure 10A:
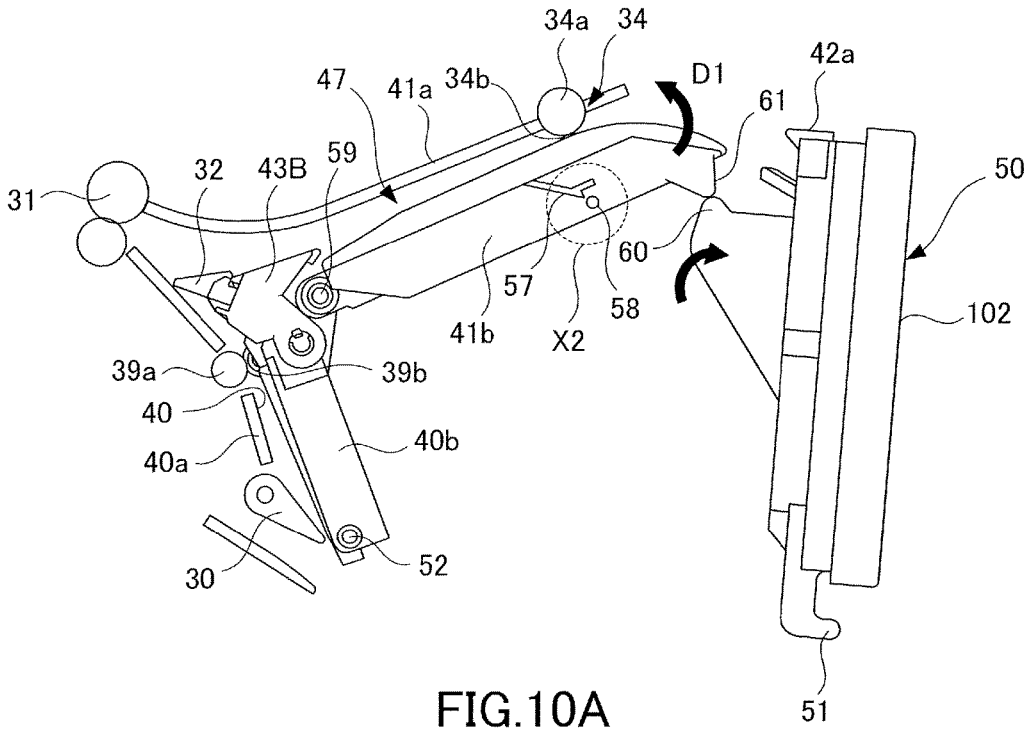
FIG. 10A is a schematic diagram illustrating an operation when the openable cover of the guide unit of the second embodiment is opened.
Figure 10B:
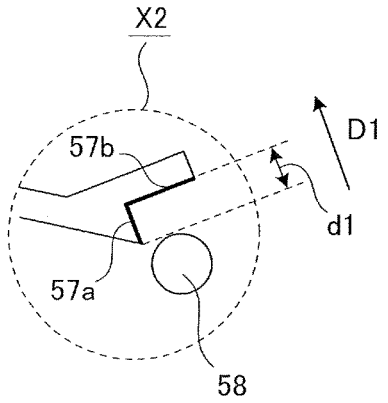
FIG. 10B is an enlarged view of the FIG. 10A.

Here, as for the guide unit 47 moving in conjunction with the opening/closing operation of the openable cover 50, configurations for positioning and for releasing the positioning of the movable guides 40*b* and 41*b* will be described with reference to FIGS. 9A through 10B. FIG. 9A is a schematic diagram illustrating the configuration for positioning the guide unit 47 and FIG. 9B is an enlarged view illustrating a notable part X1 thereof. FIG. 10A is a schematic diagram illustrating an operation of the positioning configuration in opening the openable cover 50 and FIG. 10B is an enlarged view illustrating a notable part X2 thereof.

As illustrated in FIGS. 9A and 9B, the guide unit 47 includes a contact member 57 fixed to the movable guide 41*b*. The contact member 57 is configured to abut with a fixed member 58 fixed to the frame of the apparatus body. The contact member 57 has a first contact surface 57*a* extending along a direction in which the movable guide 41*b* approaches to/moves away from the fixed guide 41*a* and a second contact surface 57*b* extending in a direction intersecting with the first contact surface 57*a*. The contact member 57 and the fixed member 58 are both disposed on both sides in the sheet width direction of the movable guide 41*b*.

The first contact surface 57*a* has a function of regulating (i) a distance between the movable guide 40*b* and the fixed guide 40*a* and (ii) a nip pressure of the conveyance roller pair 39, by abutting with the fixed member 58 to restrict the movable guide 41*b* from moving in the right direction in FIG. 9A. The second contact surface 57*b* has a function of regulating (iii) a distance between the movable guide 41*b* and the fixed guide 41*a* and (iv) a nip pressure of the re-conveyance roller pair 34, by abutting with the fixed member 58 to restrict the movable guide 41*b* from moving downward in FIG. 9A. It is noted that the shape of the contact member 57 is not limited to the illustrated one and may be modified as long as the contact member 57 can position the guide unit 47 at a proper position in a state where the openable cover is closed.

In a state where the openable cover 50 is closed, the first and second contact surfaces 57*a* and 57*b* abut with the fixed member 58, so that the movable guide 41*b* is positioned at the first position where the movable guide 41*b* forms the upstream portion 41 of the re-conveyance path 33 with the fixed guide 41*a*. The contact member 57 and the fixed member 58 are disposed such that the movable guide 41*b* located at the first position is distant from the fixed guide 41*a* by a predetermined distance and such that the movable guide 41*b* extends in parallel with a guide surface of the fixed guide 41*a* in terms of the width direction. This arrangement ensures stability of the sheet conveyance operation.

The contact member 57 and the fixed member 58 are one exemplary configuration for restricting movement of the movable guides 40*b* and 41*b*, which serve as the first and second movable guides, in a state where the openable cover is closed. The contact member 57 is a first engage portion in this embodiment provided at either one of the first and second movable guides, and the fixed member 58 is a second engage portion in this embodiment provided on the apparatus body and engageable with the first engage portion.

As a configuration for releasing the positioning of the guide unit 47 made by the contact member 57 and the fixed member 58, the openable cover 50 is provided with a lift-up cam 60 and the guide unit 47 is provided with a cam follower portion 61 abuttable with the lift-up cam 60. The cam follower portion 61 is one exemplary positioning release member capable of releasing the engagement between the first and second engage portions, and is a pressing member to press the movable guide on which the first engage portion is disposed so that the first engage portion is disengaged from the second engage portion. The cam follower portion 61 is fixedly provided on the movable guide 41*b* of the guide unit 47 and is separated from the lift-up cam 60 in a state where the openable cover 50 is closed.

In response to the opening operation of the openable cover 50, the lift-up cam 60 abuts with the cam follower portion 61 along a turning of the openable cover 50 around the rotational shaft 51 as illustrated in FIGS. 10A and 10B. Then, the cam follower portion 61 being pressed by the lift-up cam 60, the movable guide 41*b* moves upward as illustrated by an arrow D1 in FIG. 10A at a fulcrum of the link portion 59 linked with the link guide 43B, and the contact member 57 separates from the fixed member 58. It is noted that the movable guide 41*b* is regulated from moving upward in FIG. 10A beyond a predetermined position defined by positional relationships among the component members by interference with the re-conveyance roller pair 34 or by interference between the movable guide 41*b* and the fixed guide 41*a*. A movement distance d1 of the movable guide 41*b* caused by the lift-up cam 60 is set to be smaller than a distance from the first position to the above-mentioned predetermined position and to be enough so that the contact member 57 is disengaged from the fixed member 58. In this embodiment, the movement distance d1 of the movable guide 41*b* is set to be greater than a length of the first contact surface 57*a* in the direction of the arrow D1.

When the openable cover 50 is turned further in the opening direction in a state where the contact member 57 is disengaged from the fixed member 58, the guide unit 47 is pulled out through the engagement of the engage pin 53 and the guiding groove 54 as described above (see FIG. 8). Thereby, the guide unit 47 is switched to the second state and the workspace E3 is created (see FIG. 6).

When the openable cover 50 being open is closed, the movable guide 41*b* moves to a position where the first and second contact surfaces 57*a* and 57*b* face the fixed member 58. After that, when the lift-up cam 60 passes through the position of the cam follower portion 61, the movable guide 41*b* moves downward by its own weight, and the contact member 57 abuts with the fixed member 58. Thereby, the movable guides 40*b* and 41*b* are positioned at the first positions where the sheet conveyance paths 40 and 41 are formed again.

Thus, in the configuration in which the guide unit 47 is positioned by the contact member 57 and the fixed member 58 in a state where the openable cover 50 is closed, the contact member 57 is disengaged from the fixed member 58 by the lift-up cam 60 along with the opening operation of the openable cover 50. In other words, the lift-up cam 60, serving as a positioning release member, releases the engagement of the first and second engage portions along with the operation of opening the cover unit and makes the first and second movable guides movable in respective directions away from the first and second guide portions. Therefore, the first and second movable guides are positioned at proper positions for forming the sheet conveyance paths in a state where the cover unit is closed, and the linking mechanism is made operable along with the operation of opening the cover unit. Accordingly, it is possible to improve workability while assuring the stability of the sheet conveyance operation.

Still further, according to the present embodiment, the contact member 57 is disposed on the movable guide 41*b*, the fixed member 58 is disposed on the apparatus body, and the lift-up cam 60 serving as the pressing member is disposed on the openable cover 50. That is, the linking mechanism operable in conjunction with the operation of opening the cover unit is provided with a simple configuration in which the first engage portion, the second engage portion and the positioning release member are disposed respectively at either one of the first and second movable guides, the apparatus body and the cover unit.

Third Embodiment

Next, a configuration of a sheet conveying apparatus of a third embodiment will be described with reference to FIGS. 11 through 13. The sheet conveying apparatus of the present embodiment is different from that of the second embodiment in a configuration for positioning and releasing the guide unit 47. The other components common with those of the second embodiment will be denoted by the same reference numerals as those of the second embodiment, and a description thereof will be omitted here.

Figure 11A:
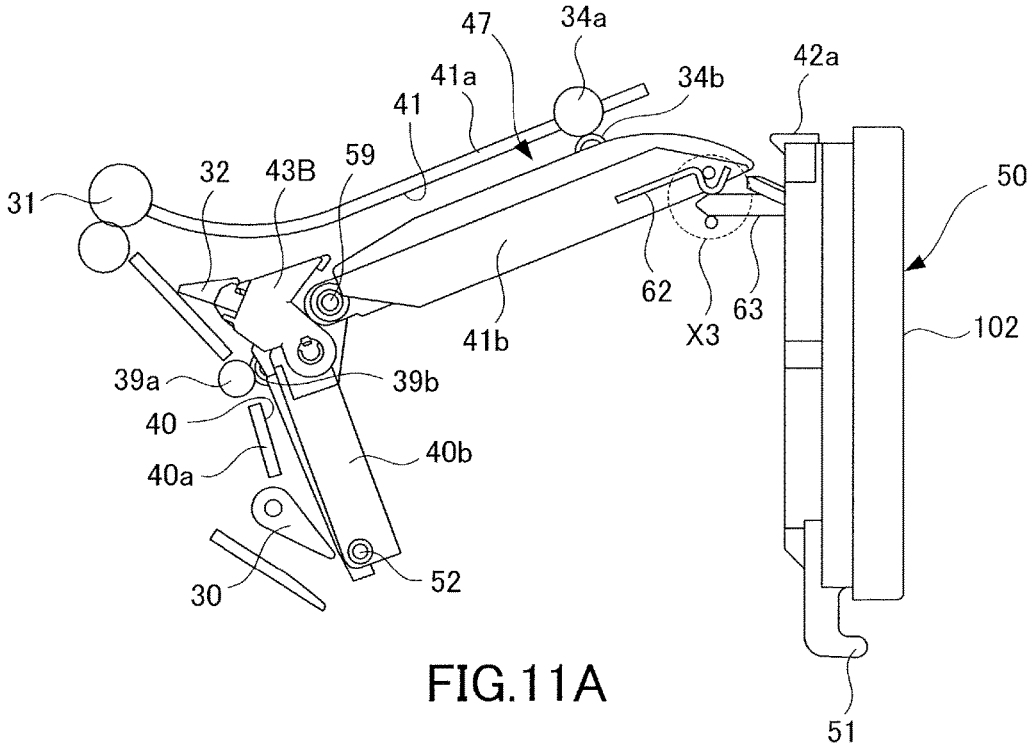
FIG. 11A is a schematic diagram illustrating a positioning configuration of a guide unit of a third embodiment.
Figure 11B:
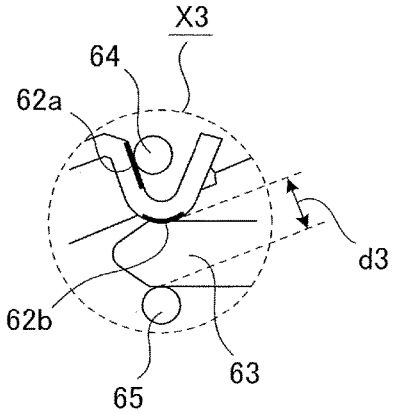
FIG. 11B is an enlarged view of the FIG. 11A.
Figure 12A:
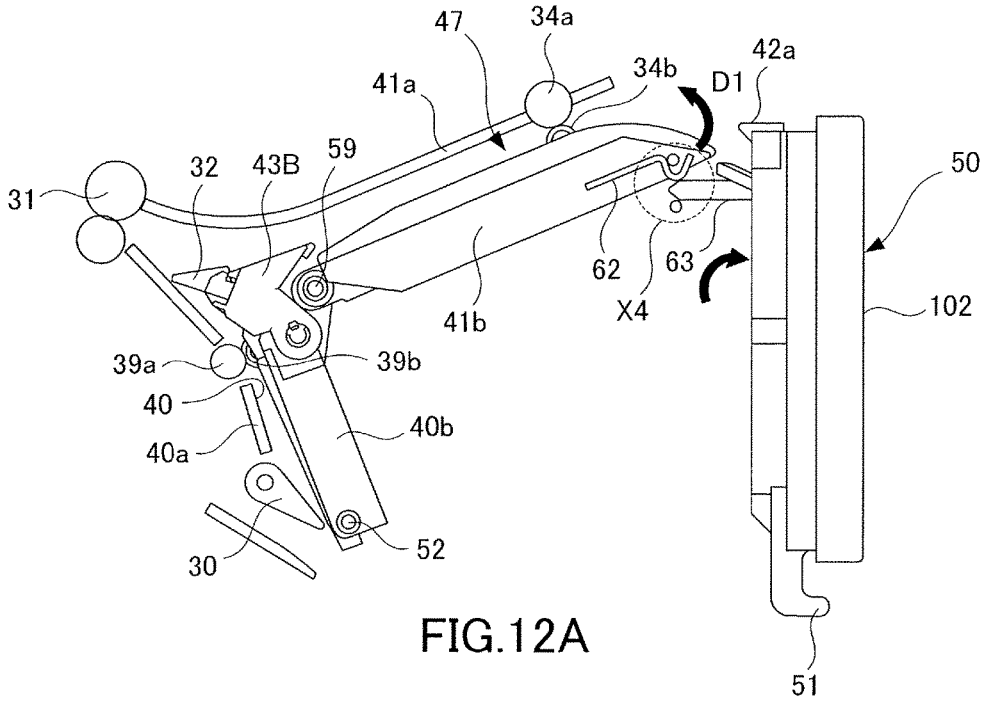
FIG. 12A is a schematic diagram illustrating an initial stage of an operation for opening an openable cover of the third embodiment.
Figure 12B:
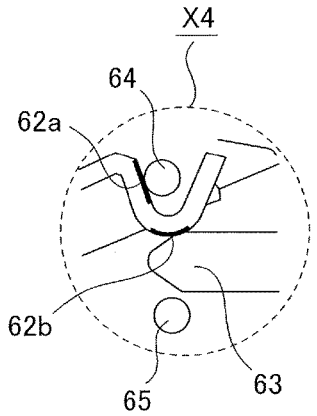
FIG. 12B is an enlarged view of the FIG. 12A.
Figure 13A:
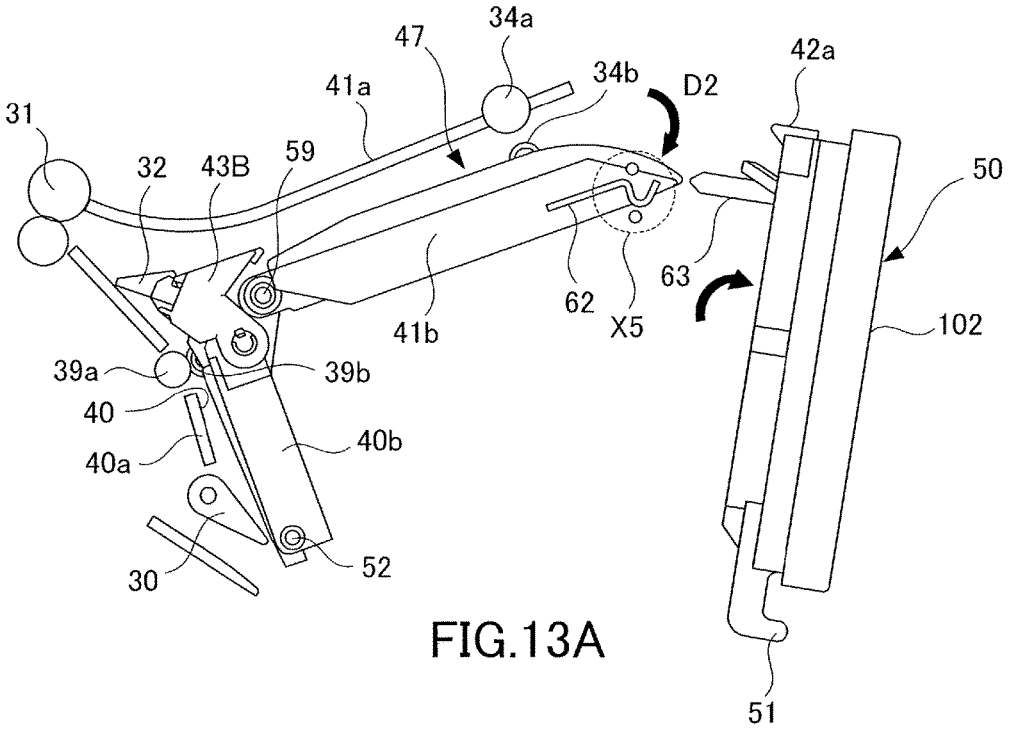
FIG. 13A is a schematic diagram illustrating a middle stage of the operation in opening the openable cover of the third embodiment.
Figure 13B:
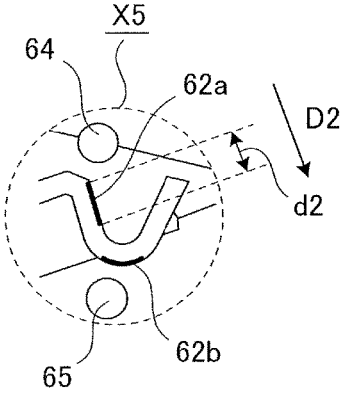
FIG. 13B is an enlarged view of the FIG. 13A.

FIG. 11A is a schematic diagram illustrating the positioning configuration of the guide unit 47 of the present embodiment. FIGS. 12A and 13A are both schematic diagrams illustrating operations of the positioning configuration in opening the openable cover 50. FIGS. 11B, 12B and 13B are all enlarged views illustrating a notable part (X3, X4 and X5) of the positioning configuration of the guide unit 47.

As illustrated in FIGS. 11A and 11B, the guide unit 47 includes a hook member 62 fixed to the movable guide 41*b*. The apparatus body is provided with two fixing pins 64 and 65 arrayed in a vertical direction. The hook member 62 has a shape opened upward (i.e., a shape engageable with the upper fixing pin 64). The hook member 62 and the fixing pins 64 and 65 are all disposed on the both sides in the sheet width direction. The hook member 62 is another example of the first engage portion, and the fixing pin 64 is another example of the second engage portion engageable with the first engage portion.

The openable cover 50 is provided with a lever 63 as a configuration for releasing the guide unit 47 positioned by the hook member 62 and the fixing pin 64. The lever 63 is another example of the positioning release member capable of releasing the positioning of the movable guide by disengaging the first engage portion from the second engage portion.

The lever 63 is configured to be positioned between the hook member 62 and the lower fixing pin 65 while being in contact with an under surface 62*b* of the hook member 62 when the openable cover 50 is closed. Accordingly, in a state where the openable cover 50 is closed, the hook member 62 is supported by the lever 63, and an engage surface 62*a* inside of the hooked shape is held at a position engaging with the upper fixing pin 64. Thereby, the movable guide 41*b* is restricted from moving in a direction away from the fixed guide 41*a*. At the same time, because the movable guide 41*b* is thus positioned, the other movable guide 40*b* is also positioned through the link guide 43B. That is, the guide unit 47 is put into the first state where the respective movable guides 40*b* and 41*b* are positioned at the first positions.

In response to an opening operation of the openable cover 50, the lever 63 moves in the right direction in FIG. 12A along with turning of the openable cover 50 around the rotational shaft 51 as illustrated in FIGS. 12A and 12B. While the hook member 62 is pushed up in a direction of an arrow D1 along a moving locus of the lever 63, the shape of the hook member 62 is set such that the movement amount of the movable guide 41*b* is smaller than the distance from the first position to the abovementioned predetermined position.

When the openable cover 50 turns further as illustrated in FIGS. 13A and 13B, the lever 63 separates from the hook member 62 and the fixing pin 64 and the movable guide 41*b* turns downward by its own weight as indicated by an arrow D2. Here, as illustrated in FIGS. 11B and 13B, such an arrangement is adopted that a distance d3 by which the lever 63 lifts the hook member 62 is greater than a length d2 of the engage surface 62*a* of the hook member 62 in terms of the turning direction of the movable guide 41*b* centering on the link portion 59. Due to that, when the movable guide 41*b* turns downward by its own weight, the hook member 62 is disengaged from the upper fixing pin 64. After that, the guide unit 47 is pulled out (see FIG. 8) by the operation of the abovementioned engage pin 53 and the guiding groove 54, and the guide unit 47 is switched into the second state, thus creating the workspace E3 (see FIG. 6).

In a case of closing the openable cover 50 being open, the lever 63 comes into contact with the hook member 62 along with turning of the openable cover 50 and moves in between the hook member 62 and the fixing pin 65 while pushing up the hook member 62. Thereby, the movable guides 40*b* and 41*b* are positioned again to the first positions where the movable guides 40*b* and 41*b* form the sheet conveyance paths 40 and 41.

As described above, in the configuration of positioning the guide unit 47 by the hook member 62 and the fixing pin 64 in a state where the openable cover 50 is closed, the hook member 62 is disengaged from the fixing pin 64 as the lever 63 moves along with the operation of opening the openable cover 50. In other words, the first and second movable guides are positioned by the lever 63 serving as the positioning release member at the position where the first and second movable guides form the sheet conveyance paths in a state where the cover unit is closed, and the positioning of the first and second movable guides are released along with the operation of opening the cover unit. Therefore, similarly to the second embodiment described above, the first and second movable guides are positioned at proper positions in a state where the cover unit is closed, and the first and second movable guides become movable and the linking mechanism becomes operable along with the operation of opening the cover unit.

Still further, according to the present embodiment, the hook member 62 is disengaged from the fixing pin 64 as the lever 63 retreats from the part between the hook member 62 and the fixing pin 65 and the hook member 62 moves downward. Therefore, as compared to the configuration of the second embodiment in which the movable guide 41*b* is pressed upward by the lift-up cam 60, the movement of the movable guide 41*b* in releasing the positioning of the guide unit 47 will be small. That is, a distance between the movable guide 41*b* and the fixed guide 41*a* can be smaller in a state where the openable cover 50 is closed, which arrangement allows to increase a degree of freedom in terms of the disposition of the members, and to design the image forming apparatus in compact.

Still further, the hook member 62 serving as the first engage portion is disposed in the guide unit 47, the fixing pin 64 serving as the second engage portion is disposed in the apparatus body, and the lever 63 as the abutment member is disposed in the openable cover 50. That is, the linking mechanism is made operable in conjunction with the operation of opening the cover unit by means of a simple configuration in which the first engage portion, the second engage portion and the positioning release member are disposed respectively in either one of the first and second movable guides of the guide unit, the apparatus body and the cover unit.

It is noted that the configuration of the first and second engage portions and the positioning release member described in the present embodiment and the second embodiment is also applicable to the guide unit 47 of the first embodiment in which the configuration of the linking mechanism is different for example. Still further, a member corresponding to the lever 63 and the lift-up cam 60 may be operated by an operator such that a user can release the positioning of the guide unit 47.

Fourth Embodiment

Figure 15:
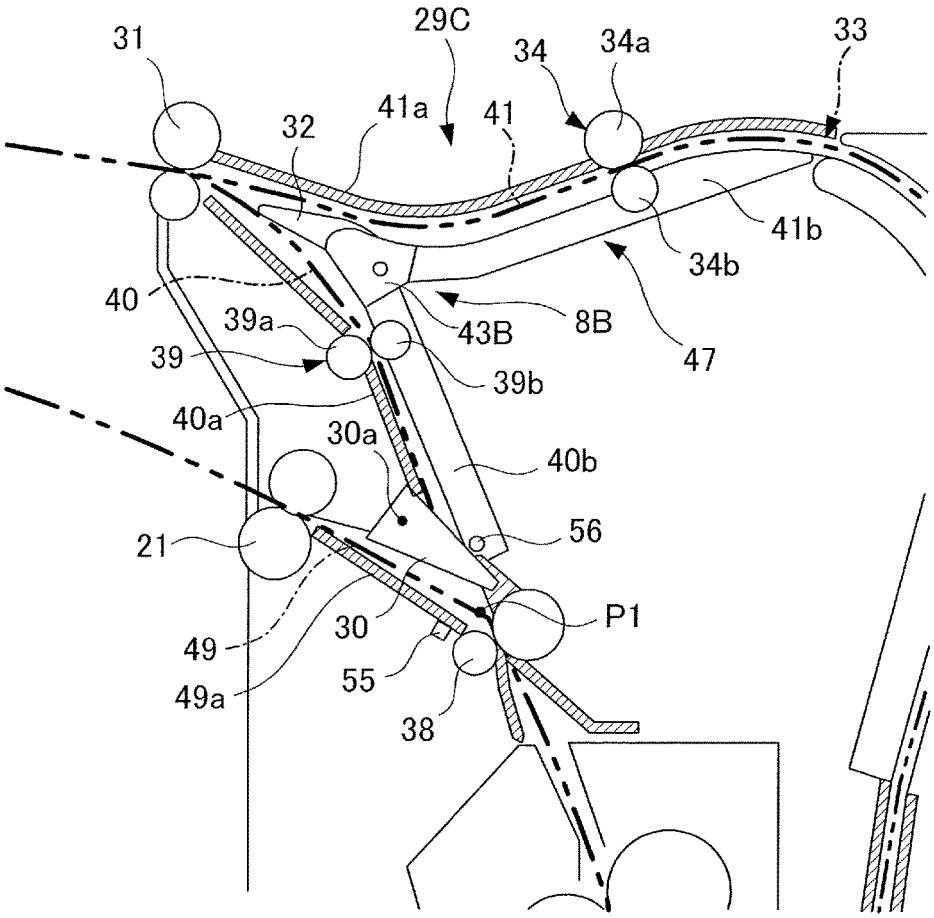
FIG. 15 is a schematic diagram illustrating the same part of the duplex conveyance portion of the fourth embodiment as the FIG. 14.
Figure 16:
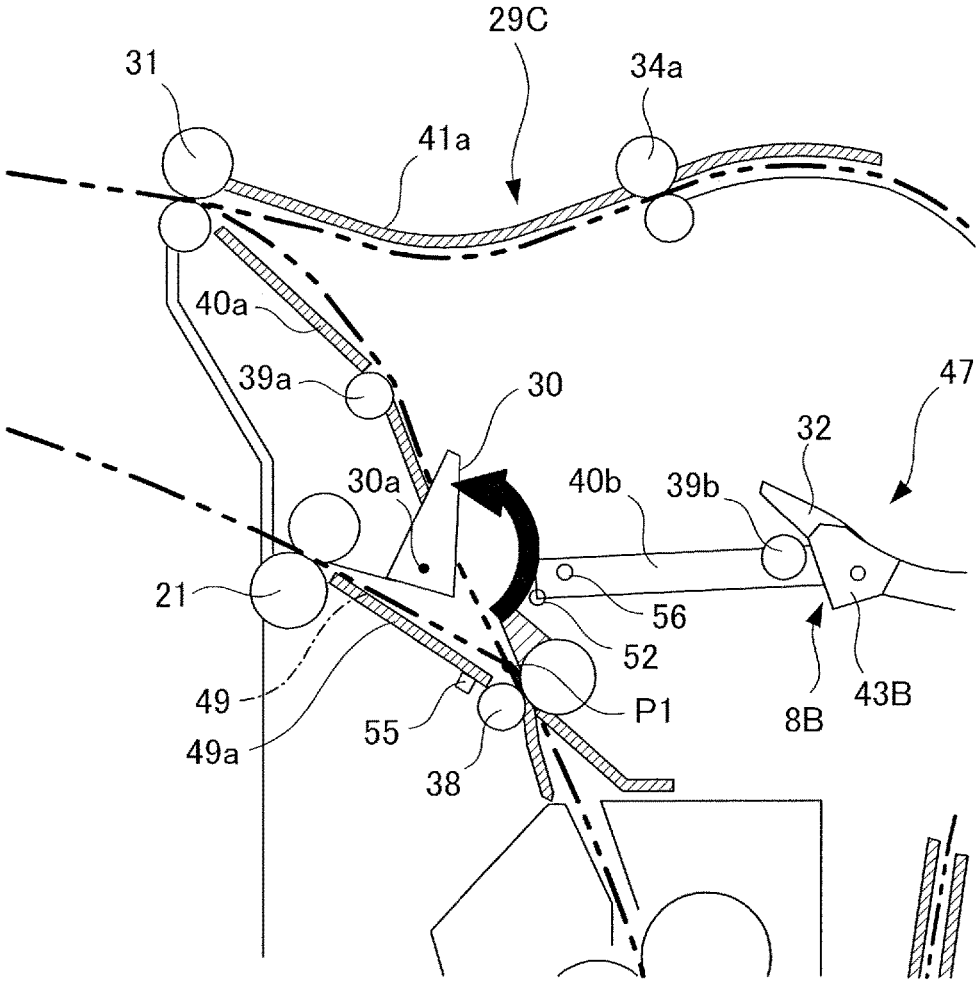
FIG. 16 is a schematic diagram illustrating an operation of a switching guide member of the fourth embodiment.

Next, a configuration of a duplex conveyance portion 29C serving as a sheet conveying apparatus of a fourth embodiment will be described with reference to FIGS. 14 through 16. The duplex conveyance portion 29C is different from that of the second embodiment in that the switching guide 30 becomes openable in a state where the openable cover 50 is opened. The other components common with those of the first and second embodiments will be denoted by the same reference numerals as those of the first and second embodiments, and a description thereof will be omitted here. It is noted that all of FIGS. 14 through 16 are schematic diagrams illustrating a main part of the duplex conveyance portion 29C.

Figure 14:
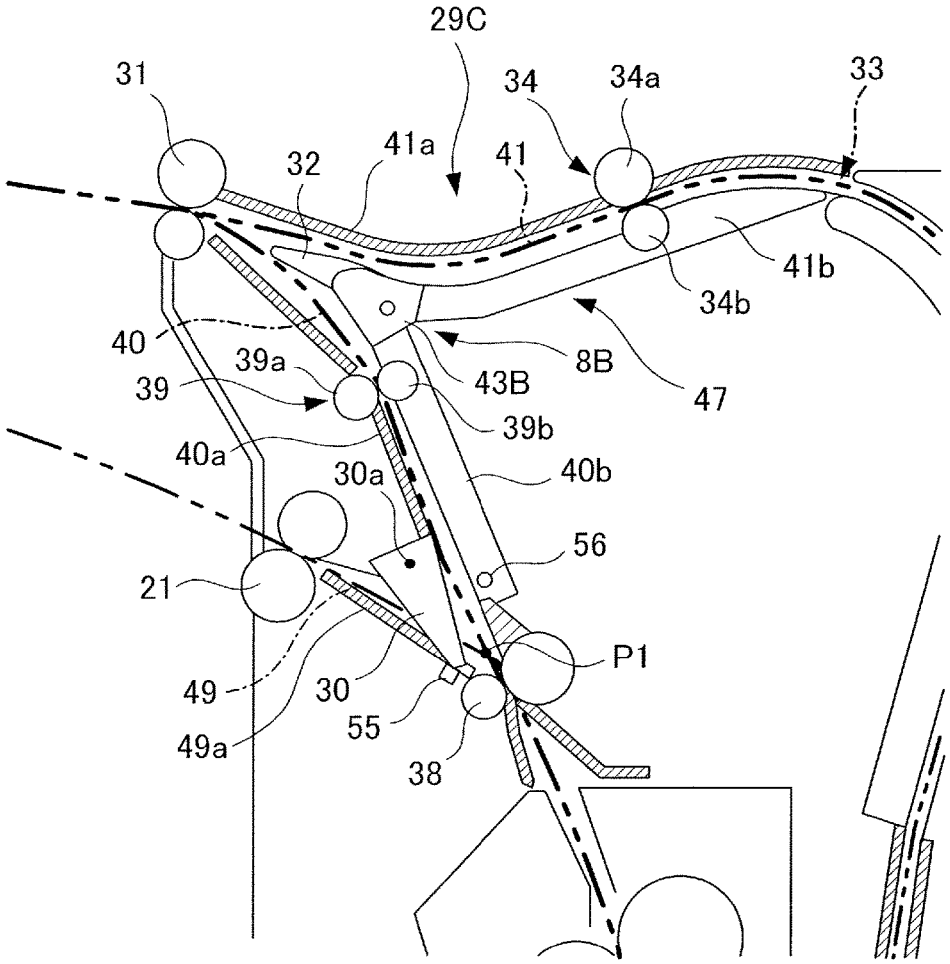
FIG. 14 is a schematic diagram illustrating a notable part of a duplex conveyance portion of a fourth embodiment.

As illustrated in FIG. 14, the switching guide 30 serving as a guide member is disposed at a branch portion P1 downstream of the conveyance roller pair 38 where the conveyance path is branched into the switchback path 40 to the switchback roller pair 31 and the discharge path 49 to the discharge roller pair 21. A discharge guide 49*a* forming the discharge path 49 is also provided between the conveyance roller pair 38 and the discharge roller pair 21. The discharge path 49 branched from the switchback path 40, which is a first conveyance path, is a third conveyance path in this embodiment, and the discharge guide 49*a* is a third guide portion in this embodiment.

The switching guide 30 is turnable pivoting on a rotational shaft 30*a* and turned by a driving force from a driving source such as a stepping motor. The switching guide 30 configured as above switches its posture between a first posture (see FIG. 14) by which the sheet delivered from the conveyance roller pair 38 is guided to the switchback path 40 and a second posture (see FIG. 15) by which the sheet delivered from the conveyance roller pair 38 is guided to the discharge path 49.

Positioning members 55 and 56 serving as contact portions that can contact the switching guide 30 are provided around the branch portion P1. The positioning member 55 is supported by the frame of the apparatus body 101 and abuts with the switching guide 30 in the first posture to restrain turning of the switching guide 30 in a clockwise direction in FIG. 14. The positioning member 56 is provided on the movable guide 40*b* and abuts the switching guide 30 in the second posture to restrain turning of the switching guide 30 in a counterclockwise direction in FIG. 15.

Here, in a state where the openable cover 50 is opened, the guide unit 47 moves along with the openable cover 50 and the movable guide 40*b* moves away from the fixed guide 40*a*. In this condition, the positioning member provided on the movable guide 40*b* retreats out of a turning locus of the switching guide 30. Accordingly, in a state where the openable cover 50 is open, the switching guide 30 is permitted to turn in a direction away from the discharge guide 49*a* (i.e., counterclockwise in FIG. 16) and to fully distant from the discharge guide 49*a*.

This arrangement improves the stability of the operation of the duplex conveyance portion 29C by regulating the movable range of the switching guide 30 in a state where the openable cover 50 is closed while improving accessibility around to the branch portion P1 and the discharge path 49 in a state where the openable cover 50 is open. Still further, because the positioning member 56 is configured as a part of the guide unit 47, the function of releasing the regulation of the switching guide 30 in conjunction with the guide unit can be realized by the simple configuration.

Other Embodiments

While the duplex conveyance portions 29, 29B and 29C which are exemplary sheet conveying apparatuses have been described in the first through fourth embodiments, this technology is also applicable to a sheet conveying apparatus composing another part of the image forming apparatus. For instance, it is applicable to a sheet feeding apparatus configured to convey a sheet delivered from a sheet feed cassette. Still further, while some image forming apparatus include an optional sheet feeding apparatus and/or a sheet processing apparatus configured to process a sheet on which an image has been formed, besides an apparatus body including an image forming portion, the technology of the present disclosure is applicable as a sheet conveying apparatus provided in such attached apparatus.

Still further, while the case of linking the two movable guides 40*b* and 41*b* has been described as an exemplary configuration for interconnecting and coordinating movements of the plurality of movable guides by the linking mechanism, a configuration may be made so as to interconnect three or more movable guides.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2017-009723, filed on Jan. 23, 2017, and 2017-093295, filed on May 9, 2017, which are hereby incorporated by reference wherein in their entirety.

What is claimed is:

1. A sheet conveying apparatus comprising:

an apparatus body provided with a first guide portion and a second guide portion;

a cover unit configured to be opened and closed with respect to the apparatus body;

a sheet conveyance portion configured to convey a sheet; and a guide unit configured to guide the sheet conveyed by the sheet conveyance portion, the guide unit comprising:

a first movable guide supported movably by the apparatus body and configured such that a first conveyance path through which the sheet conveyed by the sheet conveyance portion passes is formed between the first guide portion and the first movable guide;

a second movable guide being movable with respect to the apparatus body and configured such that a second conveyance path through which the sheet conveyed by the sheet conveyance portion passes is formed between the second guide portion and the second movable guide; and a linking mechanism comprising an intermediate member through which the first and second movable guides are linked movably with respect to each other, the linking mechanism being configured to coordinate movements of the first and second movable guides through an intermediary of the intermediate member such that the first and second movable guides are respectively moved away from the first and second guide portions along with an opening movement of the cover unit with respect to the apparatus body from a state where the first and second conveyance paths are formed respectively between the first movable guide and the first guide portion and between the second movable guide and the second guide portion, wherein one end of the first movable guide is supported turnably by the apparatus body and another end of the first movable guide is linked with the intermediate member, and wherein one end of the second movable guide is linked with the intermediate member and another end of the second movable guide is linked with the cover unit.

2. The sheet conveying apparatus according to claim 1, wherein the linking mechanism comprises a first link portion provided on the second movable guide and a second link portion provided on the cover unit and linked movably with the first link portion.

3. The sheet conveying apparatus according to claim 2, wherein one of the first and second link portions is formed into a guiding shape slidably guiding the other one of the first and second link portions, and wherein the cover unit is permitted to change its posture between an open posture and a closed posture with respect to the apparatus body by a sliding movement of the first and second link portions.

4. The sheet conveying apparatus according to claim 1, wherein the sheet conveyance portion comprises a reverse conveyance portion configured to reverse a conveyance direction of the sheet received through the first conveyance path and to send the sheet to the second conveyance path.

5. The sheet conveying apparatus according to claim 4, wherein the guide unit comprises a conveyance regulating portion supported by the intermediate member and configured to guide the sheet passing through the first conveyance path toward the reverse conveyance portion and to guide the sheet of which conveyance direction has been reversed by the reverse conveyance portion to the second conveyance path.

6. The sheet conveying apparatus according to claim 1, further comprising:

a third guide portion provided on the apparatus body and configured to form a third conveyance path branched from the first conveyance path; and a switching guide disposed at a branch portion where the first and third conveyance paths branch and configured to be switched between a first posture for guiding the sheet conveyed by the sheet conveyance portion to the first conveyance path and a second posture for guiding the sheet conveyed by the sheet conveyance portion to the third conveyance path, wherein the first movable guide comprises a contact portion that can be in contact with the switching guide, wherein the switching guide is restrained from moving in a direction away from the third guide portion beyond a range between the first and second postures by the contact portion contacting with the switching guide in a state where the first movable guide forms the first conveyance path with the first guide portion, and wherein the switching guide is permitted to move in the direction away from the third guide portion beyond the range between the first and second postures in a state where the first movable guide is moved away from the first guide portion.

7. The sheet conveying apparatus according to claim 1, further comprising:

a first engage portion disposed in the guide unit;

a second engage portion disposed in the apparatus body and configured to engage with the first engage portion such that the first and second movable guides are held at positions where the first and second conveyance paths are formed; and a positioning release member configured to disengage the first engage portion from the second engage portion such that the first and second movable guides become movable in respective directions away from the first and second guide portions by an operation of the linking mechanism.

8. The sheet conveying apparatus according to claim 7, wherein the positioning release member is a pressing member provided in the cover unit and configured to disengage the first engage portion from the second engage portion by pressing the guide unit along with the opening movement of the cover unit.

9. The sheet conveying apparatus according to claim 7, wherein the positioning release member is an abutment member provided in the cover unit and configured such that the first engage portion is restricted from moving in a direction disengaging from the second engage portion by the abutment member abutting with the first engage portion in a state where the cover unit is closed, and wherein the first engage portion is permitted to disengage from the second engage portion by the abutment member separating from the first engage portion along with the opening movement of the cover unit.

10. The sheet conveying apparatus according to claim 1, wherein the cover unit comprises a cover portion configured to cover an opening of the apparatus body in a state where the cover unit is closed with respect to the apparatus body, and wherein at least a part of the guide unit projects out of the apparatus body through the opening in a state in which the cover unit is open and in which the first and second movable guides are respectively moved away from the first and second guide portions by an operation of the linking mechanism.

11. The sheet conveying apparatus according to claim 1, wherein the sheet conveying portion comprises a first conveyance roller pair disposed along the first conveyance path, one roller of which being supported by the apparatus body and another roller of which being supported by the first movable guide, and a second conveyance roller pair disposed along the second conveyance path, one roller of which being supported by the apparatus body and another roller of which being supported by the second movable guide, and wherein nip portions of the first and second conveyance roller pairs are opened in a state where the first and second movable guides are respectively moved away from the first and second guide portions.

12. An image forming apparatus comprising:

the sheet conveying apparatus as set forth in claim 1; and an image forming portion configured to form an image on a sheet conveyed by the sheet conveying apparatus.

13. A sheet conveying apparatus comprising:

an apparatus body provided with a first guide portion and a second guide portion;

a cover unit configured to be opened and closed with respect to the apparatus body;

a sheet conveyance portion configured to convey a sheet; and a guide unit configured to guide the sheet conveyed by the sheet conveyance portion, the guide unit comprising:

a first movable guide supported movably by the apparatus body and configured such that a first conveyance path through which the sheet conveyed by the sheet conveyance portion passes is formed between the first guide portion and the first movable guide;

a second movable guide being movable with respect to the apparatus body and configured such that a second conveyance path through which the sheet conveyed by the sheet conveyance portion passes is formed between the second guide portion and the second movable guide; and a linking mechanism comprising an intermediate member through which the first and second movable guides are linked movably with respect to each other, the linking mechanism being configured to coordinate movements of the first and second movable guides through an intermediary of the intermediate member such that the first and second movable guides are respectively moved away from the first and second guide portions along with an opening movement of the cover unit with respect to the apparatus body from a state where the first and second conveyance paths are formed respectively between the first movable guide and the first guide portion and between the second movable guide and the second guide portion, wherein the cover unit comprises a cover guide portion configured to form a conveyance path located either upstream or downstream of the second conveyance path in a state where the cover unit is closed with respect to the apparatus body, and wherein at least a part of the conveyance path formed by the cover guide portion is exposed out of the apparatus body in a state where the cover unit is open with respect to the apparatus body.

14. A sheet conveying apparatus comprising:

an apparatus body provided with a first guide portion and a second guide portion;

a cover unit configured to be opened and closed with respect to the apparatus body;

a sheet conveyance portion configured to convey a sheet; and a guide unit configured to guide the sheet conveyed by the sheet conveyance portion, the guide unit comprising:

a first movable guide supported movably by the apparatus body and configured such that a first conveyance path through which the sheet conveyed by the sheet conveyance portion passes is formed between the first guide portion and the first movable guide;

a second movable guide being movable with respect to the apparatus body and configured such that a second conveyance path through which the sheet conveyed by the sheet conveyance portion passes is formed between the second guide portion and the second movable guide; and a linking mechanism comprising a support member supported by the apparatus body and movably supporting each of the first and second movable guides, the linking mechanism being configured to coordinate movements of the first and second movable guides such that the first and second movable guides are respectively moved away from the first and second guide portions along with an opening movement of the cover unit with respect to the apparatus body from a state where the first and second conveyance paths are formed respectively between the first movable guide and the first guide portion and between the second movable guide and the second guide portion, wherein the linking mechanism comprises:

an urging member configured to urge the first and second movable guides in respective directions away from the first and second guide portions; and a moving member being movable to a position where the first and second movable guides are kept at positions for forming the first and second conveyance paths by the moving member pressing the first and second movable guides while resisting against an urging force of the urging member, and to another position where the first and second movable guides are permitted to respectively move away from the first and second guide portions by the urging force of the urging member, the moving member being moved along with the opening movement of the cover unit.

* * * * *